US006941658B2

(12) United States Patent
Park

(10) Patent No.: US 6,941,658 B2
(45) Date of Patent: Sep. 13, 2005

(54) NAIL CLIPPER

(76) Inventor: Kyunghan Park, #21-52, Yokchon-Idong, Eunpyoung-ku, Seoul (KR)

( * ) Notice: Subject to any disclaimer, the term of this patent is extended or adjusted under 35 U.S.C. 154(b) by 0 days.

(21) Appl. No.: 10/771,556

(22) Filed: Feb. 3, 2004

(65) Prior Publication Data

US 2004/0158989 A1 Aug. 19, 2004

Related U.S. Application Data

(63) Continuation of application No. 10/011,576, filed on Dec. 3, 2001, now Pat. No. 6,705,014.

(30) Foreign Application Priority Data

Dec. 1, 2000 (KR) ..... 10-2000-72494
Jun. 16, 2001 (KR) ..... 20-2001-18053 U

(51) Int. Cl.[7] ..... A45D 29/02
(52) U.S. Cl. ..... 30/28; 132/75.5
(58) Field of Search ..... 30/28, 271; 132/75.5

(56) References Cited

U.S. PATENT DOCUMENTS 994,119 A 6/1911 Browning
1,552,495 A * 9/1925 Mohr ..... 72/409.02
2,570,025 A * 10/1951 Davis ..... 30/28
2,839,827 A 6/1958 David
3,089,239 A 5/1963 Loda
3,261,094 A 7/1966 Bliss
4,017,923 A 4/1977 Schantz
5,331,739 A 7/1994 Basangy
5,557,849 A 9/1996 Lee et al.
5,617,633 A 4/1997 Lee
5,819,750 A 10/1998 Moyer
5,857,268 A 1/1999 Park
5,881,735 A 3/1999 Kutnik

FOREIGN PATENT DOCUMENTS

JP 03-212206 9/1991
JP 2647561 5/1997

* cited by examiner

*Primary Examiner*—Douglas D Watts
(74) *Attorney, Agent, or Firm*—Jordan and Hamburg LLP

(57) ABSTRACT

A nail clipper, of which a fixed body is operated with a lever, is folded by a board spring, and unfolding angle between the fixing body and the lever is maintained in certain angle, so that the fingernail can be cut safely, at the same time, when the present invention is not used, a putting green is renewed by a cover board, which eliminates the angle, covering the said lever that maintains the angle by board spring.

3 Claims, 3 Drawing Sheets

NAIL CLIPPER

REFERENCE TO RELATED APPLICATION

This is a continuation application of application Ser. No. 10/011,576, now U.S. Pat. No. 6,705,014 filed Dec. 3, 2001.

BACKGROUND OF THE INVENTION

The present invention relates to a nail clipper and more particularly to a nail clipper that a fixed body is operated engaged with a lever, which is folded by a board spring. The unfolding angle between the fixing body and the lever is maintained in certain angle, so that the fingernail can be cut safely. On the other hand, when the present invention is not used, a putting green is renewed by a cover board, which eliminates the angle, covering the said lever that maintains the angle by board spring. Therefore, the present invention has a function of a plow as well as a nail clipper.

As one side of the board spring (30) of the prior invention is fixed on the end of the fixed body (10) according to FIG. 4 and FIG. 5, the board spring (30) is placed inside of the fixed body (10) as shown in the FIG. 2. The lever (20) is combined with the fixed body (10) inside and folded using a pin (40), while the cover board (70) presses the lever that maintains the angle as shown in FIG. 7.

However, the lever (20) that is combined with the fixed body (10) can be set apart from the fixed body (10) continuously, so the angle of setting apart is too broad, which makes a user damage his skin beneath a toenail carelessly.

Furthermore, although a file is formed on the cover board (70), this kind of cover board (70) is only to press the lever (20) that maintains the angle, so another usage is required.

SUMMARY OF THE INVENTION

Thus, in order to solve the above-mentioned problem, a protrusion part is formed on the back of the cutting edge, and placed on the lever, which enables for cuttings edges to be set apart and maintained in a certain angle, and then the cover board is cut to form as 'U', so that it can be used for renewing the green of golf course.

BRIEF DESCRIPTION OF THE ATTACHED DRAWINGS

DETAILED DESCRIPTION OF PREFERRED EMBODIMENT

The following is the detailed description of the most desirable embodiment of the present invention. The most desirable embodiment of this invention will be described in detail according to the attached drawings on the following and the same reference number will be used to mean the same drawing elements regardless of different drawings.

Figure 1:
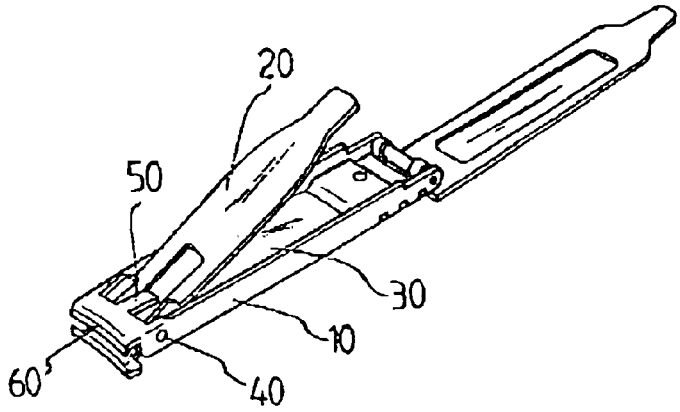
FIG. 1 is a perspective view according to an embodiment of a nail clipper.

For the embodiment of the present invention is described as shown in the FIG. 1, the lever (20) is inserted into the fixed body (10), combined and folded by the pin (40). The forward part of the board spring (30), which is fixed on the end of the fixed body (10), is placed on the back of the lever (20), so that the lever (20), which is pressed by maintaining a regular angle between the fixed body (10) and the lever (20), works continuously with the elasticity of the board spring (30). The protrusion part (50) is formed from the forward part of the fixed body (10) to the inside and placed on the forward part of the lever (20), so that the lever (20) maintains the angle in regular.

Figure 2:
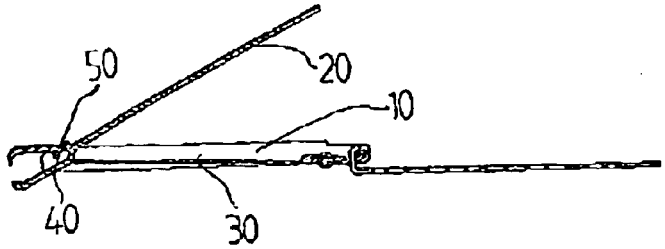
FIG. 2 is a lateral view showing according to an embodiment of a nail clipper.
Figure 3:
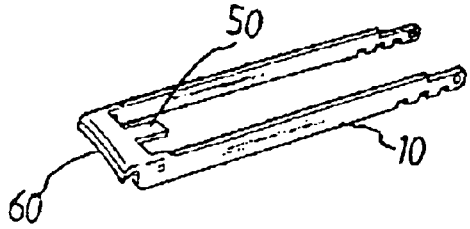
FIG. 3 is a perspective view showing the lever of the nail clipper.
Figure 4:
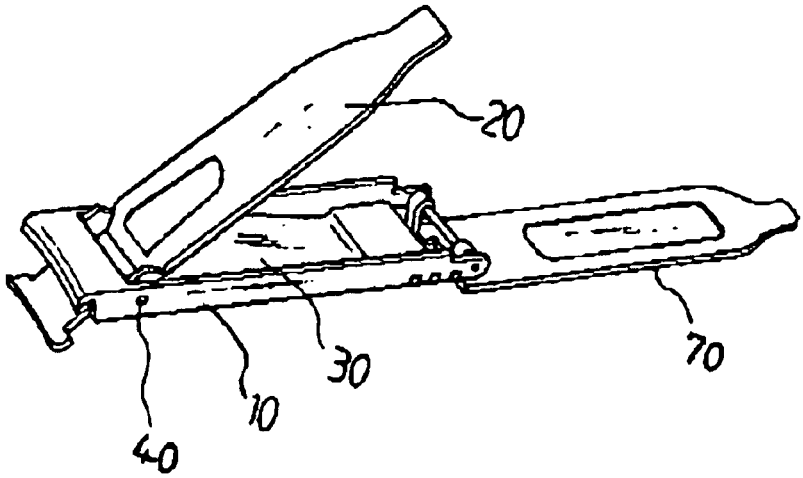
FIG. 4 is a perspective view according to an embodiment of the prior art.
Figure 5:
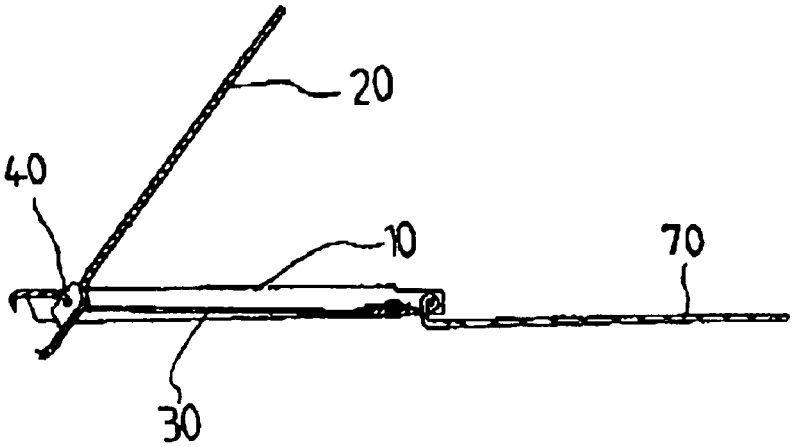
FIG. 5 is a lateral view showing according to an embodiment of the prior art.
Figure 6:
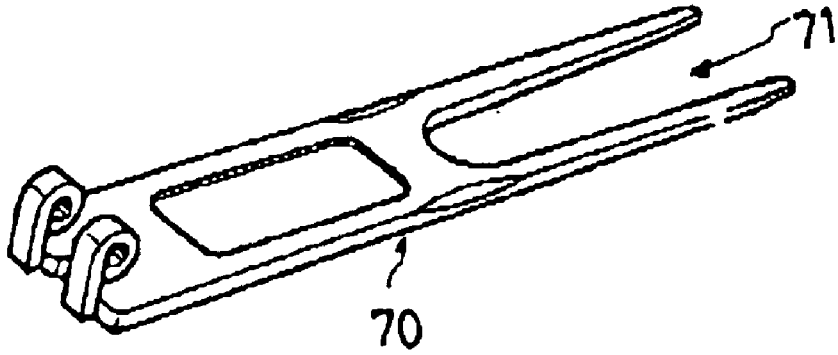
FIG. 6 is a perspective view according to an embodiment of the cover board.
Figure 7:
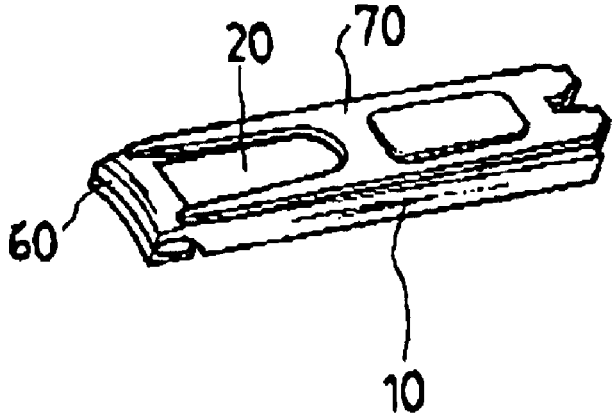
FIG. 7 is a perspective view showing that the cover board folds the lever.

As indicated above, and illustrated in FIGS. 1 through 3, the lever 20 angularly extends from the fixed body 10 to a maximum angle when the lever is in an opened position. Furthermore, the protrusion part 50 extends by a fixed amount from an inside edge of the forward part of the fixed body 10. In FIG. 3, the protrusion part 50 extends parallel to the fixed body, but the protrusion part 50 may angularly extend from the fixed body. It is to be appreciated that the maximum angular extension of the lever can have different values in different nail clippers if the protrusion part 50 is manufactured with different lengths, different extension angles, or both.

In addition, the cutting part 'U ' (71) is formed on the forward part of the cover board (70) that presses the lever (20) and folded for keeping, so that it can be used as a mini-plow for renewing the green of golf course after swing.

Thus, when the lever (20) is pressed by the board spring (30) that is fixed on the end of the fixed body (10), the lever (20) works continuously by the elasticity of the board spring (30). The protrusion part (50) of the fixed body (10) maintains the opening angle of the lever (20) and it can be used as a mini-plow for renewing the green of golf course after swing.

What is claimed is:

1. A nail clipper comprising:

a fixed body, said fixed body having a forward part;

a pin, said pin being connected to said fixed body;

a lever, said lever being rotatably connected to said pin, said lever adapted for being in one of an opened configuration and a closed configuration;

a cover board, said cover board adapted for being in one of an opened configuration and a closed configuration, said cover board covering said lever when said lever and said cover board are both in said closed configurations;

a board spring, said board spring being connected to said fixed body, said board spring outwardly urging said lever so that:

(1) when said cover board and said lever are both in said closed configurations, said cover board and said lever being urged to remaining in said closed configurations; and (2) when said lever is in said opened configuration, said lever angularly extending from said fixed body to a maximum angular extension; and a protrusion part, said protrusion part extending inwardly by a fixed distance from said forward part of said fixed body, said protrusion part contacting said lever when said lever is in said opened configuration to define said maximum angular extension of said lever.

2. The nail clipper of claim 1, wherein said cover board having a forward part, said forward part forming a U shape.

3. The nail clipper of claim 2, wherein said cover board is adapted for repairing a golf course green.

* * * * *